US008302510B2

(12) United States Patent
Macor

(10) Patent No.: US 8,302,510 B2
(45) Date of Patent: Nov. 6, 2012

(54) MULTI-SOCKET WRENCH

(75) Inventor: Richard J. Macor, Hunterdon County, NJ (US)

(73) Assignee: Proprietary Technologies, Inc., Hunterdon County, NJ (US)

( * ) Notice: Subject to any disclaimer, the term of this patent is extended or adjusted under 35 U.S.C. 154(b) by 319 days.

(21) Appl. No.: 12/661,355

(22) Filed: Mar. 16, 2010

(65) Prior Publication Data

US 2011/0120275 A1 May 26, 2011

Related U.S. Application Data

(63) Continuation-in-part of application No. 29/348,042, filed on Nov. 20, 2009, now Pat. No. Des. 616,274.

(51) Int. Cl.
*B25B 13/06* (2006.01)
*B25B 13/28* (2006.01)
*B25B 23/16* (2006.01)

(52) U.S. Cl. ..... 81/124.5; 81/177.7

(58) Field of Classification Search ..... 81/177.7, 81/177.8, 124.4, 124.5, 125, 125.1
See application file for complete search history.

(56) References Cited

U.S. PATENT DOCUMENTS

| | | | | |
|---|---|---|---|---|
| 5,557,992 | A * | 9/1996 | Macor | 81/124.5 |
| 6,637,299 | B1 * | 10/2003 | Steele | 81/124.5 |
| 6,691,595 | B2 * | 2/2004 | Hsien | 81/124.5 |
| 7,047,844 | B1 * | 5/2006 | Macor | 81/124.4 |
| 7,340,984 | B2 * | 3/2008 | Hsieh | 81/177.85 |

* cited by examiner

*Primary Examiner* — David B Thomas

(57) ABSTRACT

The present invention is a multi-socket wrench that includes an elongated main member with an upper area, a lower area, a first end, a second end, and a middle section. The present invention has at least two wrench units with two sockets positioned side by side thereon. One of the at least two wrench units is rotatably attached at the upper area, and the other of the at least two wrench units is rotatably attached at the lower area of the first end of the elongated main member. The present invention also includes an attachment means for attaching the wrench units to the elongated main member. The present invention also includes at least one pivoting means formed in the elongated main member so that the first end of the elongated main member may be pivotably moved relative to the second end of the elongated main member. In some embodiments, the present invention may have four wrench units with one attached at the upper area of the first end, one attached at the lower area of the first end, one attached at the upper area of the second end, and one attached at the lower area of the second end.

16 Claims, 4 Drawing Sheets

Fig. 4
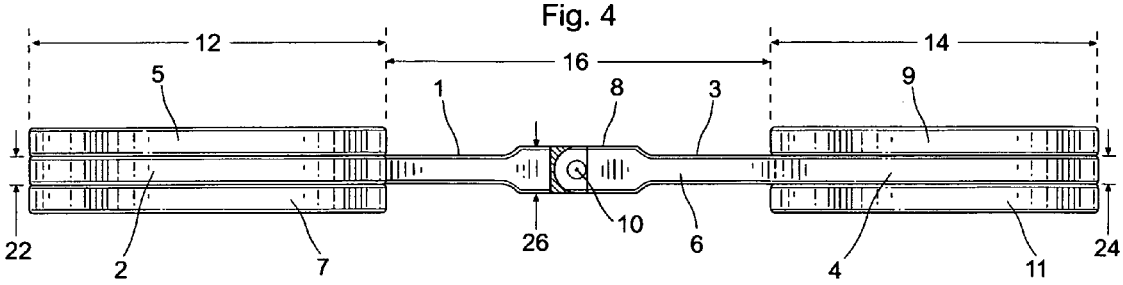
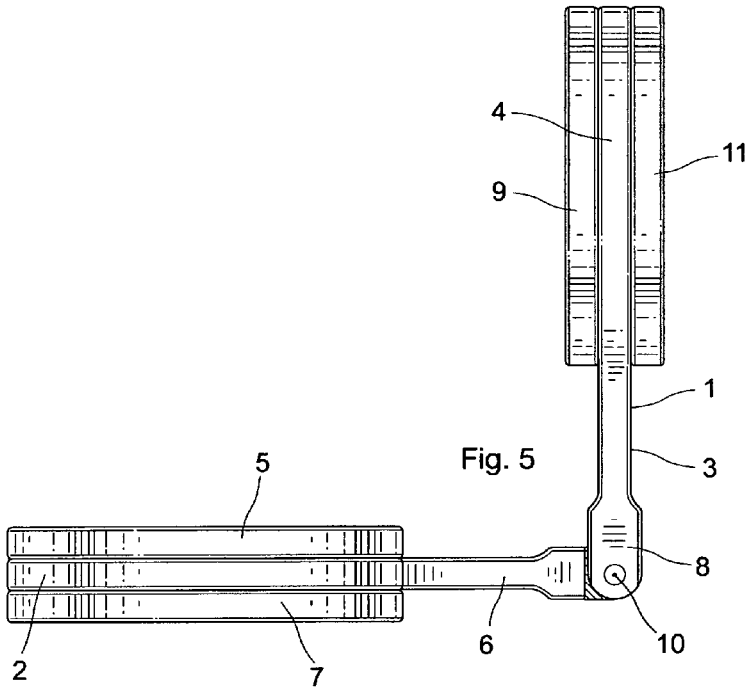
Fig. 5
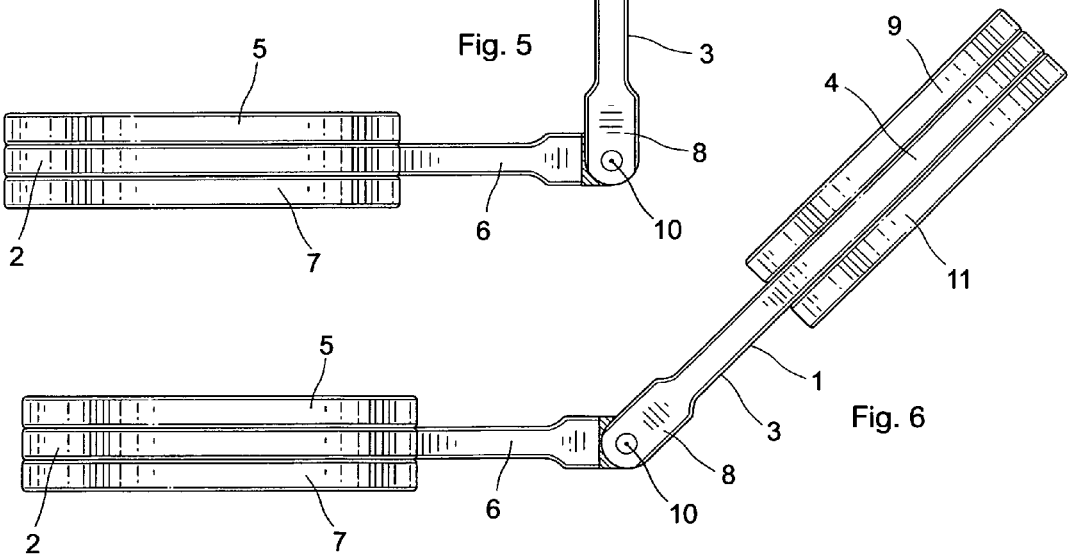
Fig. 6

MULTI-SOCKET WRENCH

REFERENCES TO RELATED APPLICATIONS

This application relates to and is a continuation-in-part of U.S. application Ser. No. 29/348,042 filed on Nov. 20, 2009 now U.S. Pat. No. D,616,274 entitled MULTI-SOCKET WRENCH. Other related patents include U.S. Pat. Nos. D342,653; 5,557,992; D375,667; and 7,047,844 all of which have been granted to the same inventor herein.

FIELD OF THE INVENTION

The present invention relates to hand tools, particularly wrenches, and most particularly wrenches having multiple size capabilities and/or multiple sockets of different sizes.

BACKGROUND OF THE INVENTION

Over the years there have been numerous wrenches developed which have multiple size capabilities. For example, an adjustable open end wrench has a fixed jaw member and a movable jaw member which is adjustable to engage with many different size work pieces. This type of wrench has a large wrench head for adjustability and strength which requires additional clearance around a work piece for engagement of the wrench head and/or additional work space for the wrench to swing and turn for re-engagement, than that of a conventional wrench having a single size. In addition, this type of "open end" adjustable wrench is much weaker than a closed end or "box" type wrench and will frequently slip upon a work piece being turned resulting in work piece deformation and/or wrench wear.

An adjustable "box" type wrench has a fixed jaw member and a movable jaw member which is adjustable to engage with many different size work pieces. This type of wrench also has a large wrench head for adjustability and strength, which requires additional clearance around a work piece for engagement of the wrench head and/or additional work space for the wrench to swing and turn for re-engagement, than that of a conventional wrench having a single size.

There are also many other known multi-size and/or multi-socket wrenches including those with a cluster of sockets at each end of the wrench. These also require additional clearance around the work piece for engagement of the socket(s) and/or additional work space for the wrench to swing and turn for re-engagement, than that of a conventional wrench having a single socket or size.

Accordingly, there is a need for a better multi-size wrench which does not require additional clearance around a work piece for engagement of the wrench head or socket(s) and/or additional work space for the wrench to swing and turn for re-engagement, than that of a conventional wrench having a single socket or size.

SUMMARY OF THE INVENTION

The present invention is a multi-socket wrench that includes an elongated main member with an upper area, a lower area, a first end, a second end, and a middle section. The present invention has at least two wrench units with two sockets positioned side by side thereon. One of the at least two wrench units is rotatably attached at the upper area, and the other of the at least two wrench units is rotatably attached at the lower area of the first end of the elongated main member. The present invention also includes an attachment means for attaching the wrench units to the elongated main member.

The present invention also includes at least one pivoting means formed in the elongated main member so that the first end of the elongated main member may be pivotably moved relative to the second end of the elongated main member. In some embodiments, the present invention may have four wrench units with one attached at the upper area of the first end, one attached at the lower area of the first end, one attached at the upper area of the second end, and one attached at the lower area of the second end.

Accordingly, it is an important objective of the present invention described herein that it has multiple size capability.

It is another objective of the present invention that each wrench head be relatively small and efficient in design without protruding sockets or hardware so that the wrench head does not require additional clearance around a work piece for engagement of each socket, and/or additional work space for the wrench to swing and turn for re-engagement, than that of a conventional wrench having a single size at one end thereof.

It is another objective of the present invention that the main member or handle be bendable into different configurations to provide for optimum accessibility and engagement of each and all of its multiple sockets.

It is another objective of the present invention that it has a strong design to ensure durability.

It is another objective of the present invention that it is commercially viable, simple in design and cost-efficient to manufacture.

BRIEF DESCRIPTION OF THE DRAWINGS

The present invention is more fully understood when the specification herein is taken in conjunction with the drawings appended hereto, wherein.

DETAILED DESCRIPTION OF THE DRAWINGS

The various drawings provided herein are for the purpose of illustrating possible embodiments of the present invention and not for the purpose of limiting same. Therefore, the drawings herein represent only a few of the many possible embodiments, variations and/or applications of the present invention.

Figure 1:
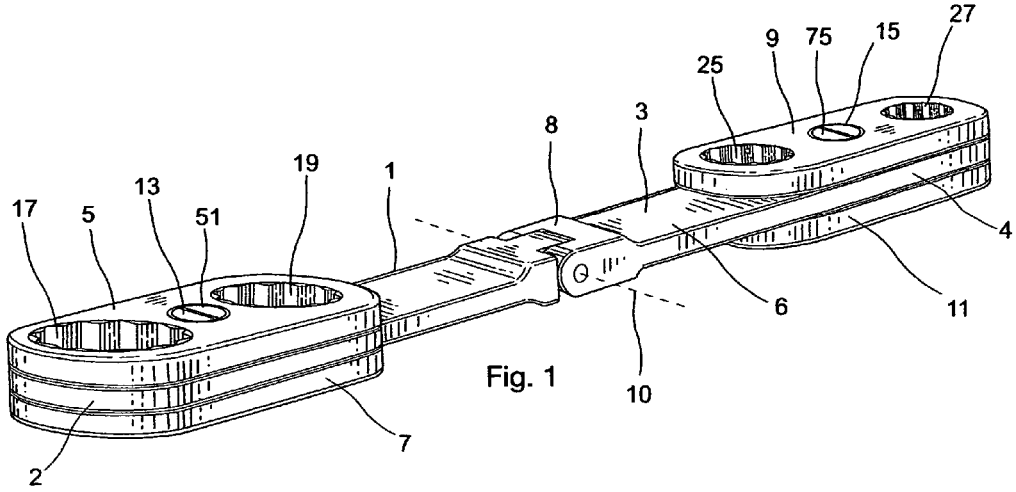
FIG. 1 shows a top front perspective view of a present invention multi-socket wrench; and, FIG. 2 shows a top view of the present invention multi-socket wrench shown in FIG. 1; and, FIG. 3 shows a bottom view of the present invention multi-socket wrench shown in FIGS. 1 and 2; and, FIG. 4 shows a right side elevation view of the present invention multi-socket wrench shown in FIGS. 1 through 3; and, FIGS. 5 and 6 show right side views of the present invention multi-socket wrench shown in FIGS. 1 through 4 above, with the first end of the elongated main member pivotably moved relative to the second end of the elongated main member; and, FIGS. 7 and 8 show top views of the present invention multi-socket wrench shown in FIGS. 1 through 6, but with one of the wrench units being rotated to alter the work position of the sockets thereon; and, FIG. 9 shows a right side, cut view of a portion of the present invention multi-socket wrench shown in FIGS. 1 through 8, illustrating an attachment means for two wrench units; and, FIG. 10 shows a top partial view of the elongated main member of the present invention wrench shown in FIGS. 1 through 9, illustrating a locking slot; and, FIG. 11 shows a top view of another embodiment of the present invention multi-socket wrench with the wrench units having open end sockets; and, FIG. 12 shows a top view of another embodiment of the present invention multi-socket wrench with a pivoting means that has two pivot axes; and, FIG. 13 shows a right side view of the present invention multi-socket wrench shown in FIG. 12, with the wrench folded into a compact form.
Figure 2:
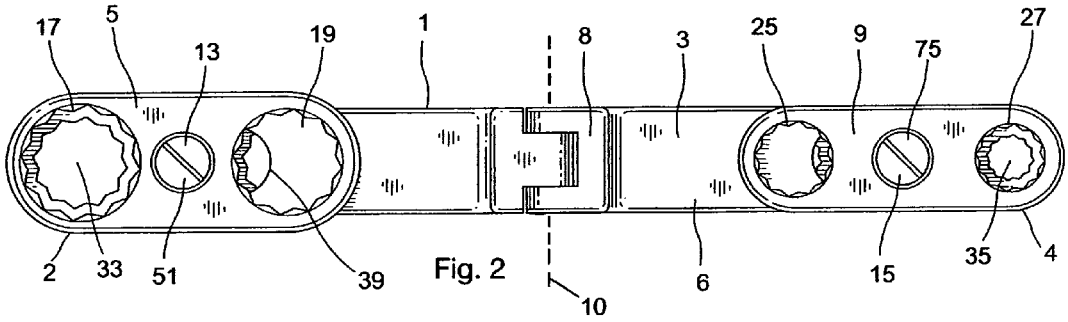
Figure 3:
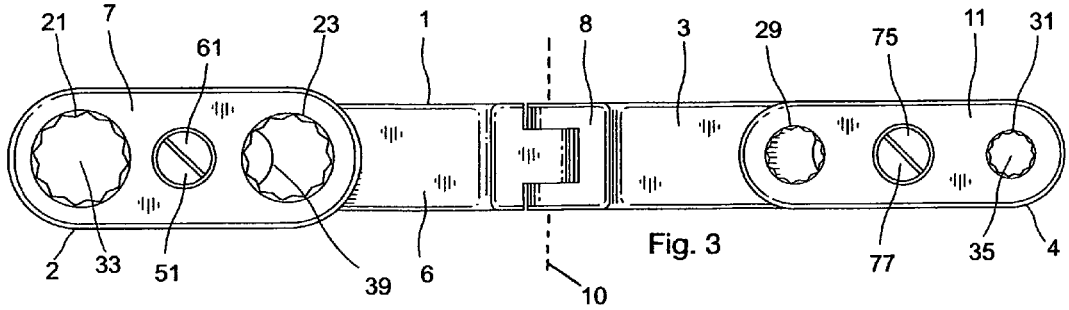

Referring to FIGS. 1, 2 and 3 simultaneously, there is shown a top front perspective view of a present invention multi-socket wrench in FIG. 1, and this is shown in its top view in FIG. 2, and its bottom view in FIG. 3. Multi-socket wrench 1 has an elongated main member 3, and wrench units 5 and 7 located on the left end of elongated main member 3. Wrench unit 5 is on top and wrench unit 7 is on the bottom. Both wrench units 5 and 7 are attached to elongated main member 3 by attachment means 51 which includes fastener screws 13 shown in FIGS. 1 and 2, and fastener screw 61 shown in FIG. 3. Fastener screws 13 and 61 are components of attachment means 51 and rotatably attach wrench units 5 and 7 to elongated main member 3. Likewise, at the opposite side of elongated main member 3 is wrench unit 9 on the top and wrench unit 11 on the bottom. Both wrench units 9 and 11 are attached to elongated main member 3 by attachment means 75 which includes fastener screw 15 shown in FIGS. 1 and 2, and fastener screw 77 shown in FIG. 3. Fastener screws 15 and 77 are components of attachment means 75 and rotatably attach wrench units 9 and 11 to elongated main member 3. Thus, each of wrench units 5, 7, 9 and 11 are arranged so as to rotate clockwise or counterclockwise upon elongated main member 3.

Wrench unit 5 includes a first socket size 17 and a second socket size 19, and wrench unit 7 has a third socket size 21 and a fourth socket size 23. These are clearer in FIGS. 2 and 3. Likewise, wrench unit 9 has a fifth socket size 25 and a sixth socket size 27 and, finally, wrench unit 11 has a seventh socket size 29 and an eighth socket size 31, as shown. The sockets 17,19,21,23,25,27,29 and 31 may be of any size or any combination of sizes but are preferably arranged in an order that would make up a set of wrenches or sockets. For example, a preferred sizing arrangement may be ¾, 11/16, ⅝, 9/16, ½, 7/16, ⅜ and 5/16 inches. Also, if the socket openings were to be of the 12 point design shown here, multi-socket wrench 1 would require only 30 degrees of work space for the wrench to swing and turn for re-engagement, providing it a distinct advantage over all adjustable (open-end or box) type wrenches.

Elongated main member 3 includes orifices 33 and 35 to provide for maximum usage of the present invention multi-socket wrench 1 and allows a threaded stud of a bolt or work-piece to pass through two aligned sockets. Also shown in FIGS. 2 and 3 is round portion 39 of a locking slot discussed further in conjunction with FIGS. 7,8,9 and 10 below.

Elongated main member 3 has a first end 2, a second end 4, and a middle section 6, all of which are more fully defined in FIG. 4. Formed in the middle section 6 of elongated main member 3 is pivoting means 8 which has pivot axis 10. Pivoting means 8 allows the first end 2 of elongated main member 3 to be pivotably moved relative to the second end 4 of elongated main member 3. And, pivoting means 8 has a pivot axis 10 located within the middle section 6 of elongated main member 3 to provide optimum accessibility and engagement of each and all of sockets 17, 19, 21, 23, 25, 27, 29 and 31 which is further described and defined in FIGS. 4, 5 and 6 below.

FIG. 4 shows a right side elevation view of the present invention multi-socket wrench shown in FIGS. 1 through 3, and components visible in this view are numbered accordingly. In this view, the first end 2, the second end 4, and the middle section 6 of elongated main member 3 are defined by length dimensions 12, 14 and 16 respectively. Each of the first end 2, the second end 4, and the middle section 6 of elongated main member 3 are about equal in length to each other, and this dimensional relationship is the same for all embodiments of the present invention. In other words, in all embodiments of the present invention the first end 2 (which is defined by dimension 12 in this figure) is one third of the total length of the elongated main member 3; and, the second end 4 (which is defined by dimension 14 in this figure) is one third of the total length of elongated main member 3; and, the middle section 6 (which is defined by dimension 16 in this figure) is one third of the total length of elongated main member 3.

All embodiments of the present invention multi-socket wrench have at least one pivoting means with each such pivoting means defined by at least one pivot axis. In this FIG. 4 multi-socket wrench 1 has at least one pivoting means 8 defined by at least one pivot axis 10. The pivoting means 8 is formed in the elongated main member 3 so that the first end 2 of the elongated main member 3 may be pivotably moved relative to the second end 4 of the elongated main member 3, to provide optimum accessibility and engagement of each and all of sockets 17, 19, 21, 23, 25, 27, 29 and 31 (which are not seen in this FIG. 4 but seen in other FIGS. 1 through 3.)

Another structural characteristic of the present invention is that each such pivoting means is formed having at least one pivot axis located within the defined middle section of the elongated main member. As shown here in FIG. 4, pivoting means 8 has a single pivot axis 10 which is located within middle section 6 defined by dimension 16 which is the middle third of elongated main member 3 of multi-socket wrench 1.

Also seen in this right side elevation view of the present invention multi-socket wrench is that the first end 2 of elongated main member 3 which is defined by dimension 12 has a thickness dimension 22; and, the second end 4 of elongated main member 3 which is defined by dimension 14 has a thickness dimension 24; and, the middle section 6 of elongated main member 3 which is defined by dimension 16 has a thickness dimension 26. Another structural characteristic of the present invention multi-socket wrench when viewed from a side view thereof, is that the first end 2, the second end 4, and middle section 6 each have at least one thickness dimension; and, the middle section 6 will always have at least one thickness dimension greater than at least one thickness dimension of each of the first and second ends 2 and 4 respectively of the elongated main member 3. It should be noted that the first end may have different thicknesses in the same wrench; and, the second end may have different thickness in the same wrench; and, the middle section may have different thicknesses in the same wrench as shown, but in all cases the middle section 6 will always have at least one thickness dimension greater than at least one thickness dimension of each of the first and second ends 2 and 4 respectively in this Figure. Such a configuration solves the complex structural puzzle of combining optimum tool efficiency, functionality, accessibility, strength, ergonomics and cost of the present invention multi-socket wrench.

FIGS. 5 and 6 show right side views of the present invention multi-socket wrench 1 shown in FIGS. 1 through 4 above, with the first end 2 of the elongated main member 3 pivotably moved relative to the second end 4 of elongated main member 3. In some preferred embodiments of the present invention, the first end of the elongated main member may be pivotably moved as much as 180 degrees or more, relative to the second end of the elongated main member. For example, in FIG. 5 the first end 2 of elongated main member 3 is positioned perpendicular (90 degrees) relative to the second end 4 of elongated member 3. Accordingly, if the second end 4 was also able to be swung down completely in the opposite position, this would create a total swing arc of 180 degrees.

Figure 7:
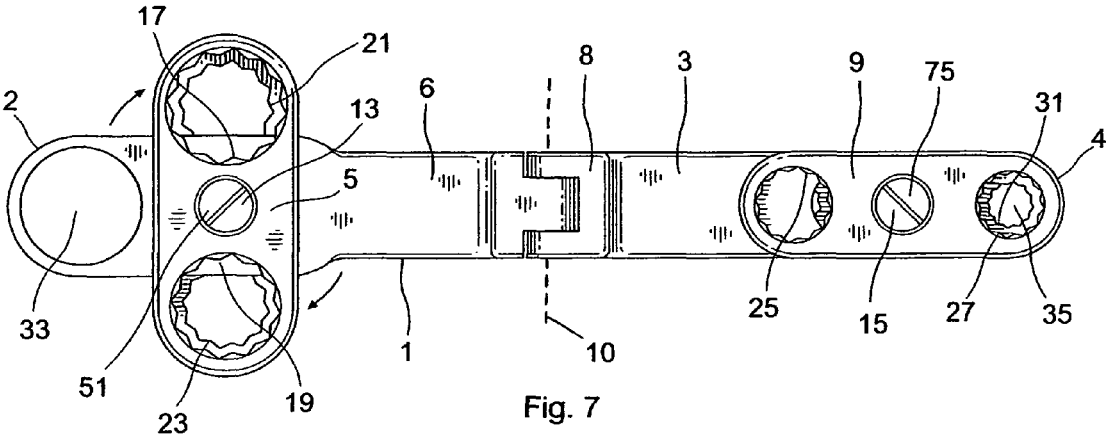
Figure 8:
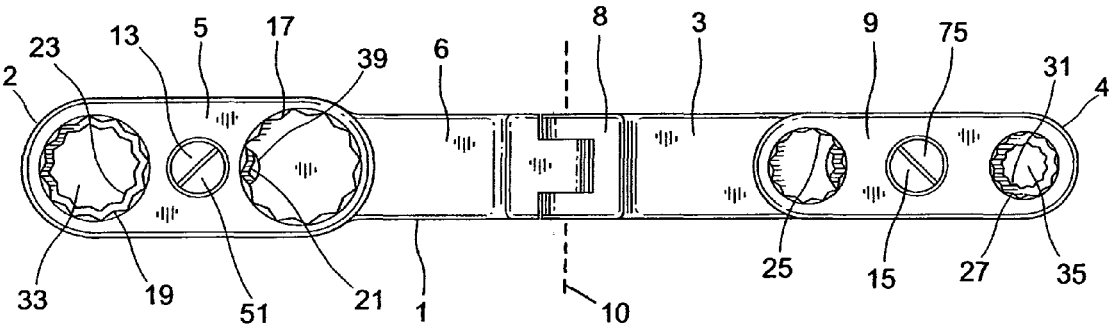

FIGS. 7 and 8 show top views of the present invention multi-socket wrench shown in FIGS. 1 through 6, but with one of the wrench units being rotated to alter the work position of the sockets thereon. Multi-socket wrench 1 shown here in FIGS. 7 and 8 is the same as shown in FIG. 2, with identical parts and reference numbers, however, wrench units 5 and 7 are rotated in a clockwise manner as represented by the arrows in FIG. 7. As can be seen, the wrench units 5 and 7 are rotated together and thus, first size socket 17 is positioned (after rotation) to the inside, instead of the outside; and, second size socket 19 ends up positioned to the outside, instead of the inside, of the first end 2 of elongated main member 3 as shown in FIG. 8. Likewise, third socket size 21 is positioned (after rotation) to the inside, instead of the outside; and, forth size socket 23 ends up positioned to the outside, instead of the inside, of the first end 2 of elongated main member 3 as shown in FIG. 8. In other words, through the rotation of wrench units 5 and 7, it can be seen by comparing FIGS. 2 and 8 that the two sockets 17 and 19 have been juxtapositioned; and, the two sockets 21 and 23 have been juxtapositioned. Likewise, wrench units 9 and 11 can be rotated accordingly, and the result is that any of the eight different socket sizes available on this wrench 1 may be positioned to the outside of elongated main member 3 so as to rest over opening 33 or 35 as shown, to engage with and turn a work piece.

Figure 9:
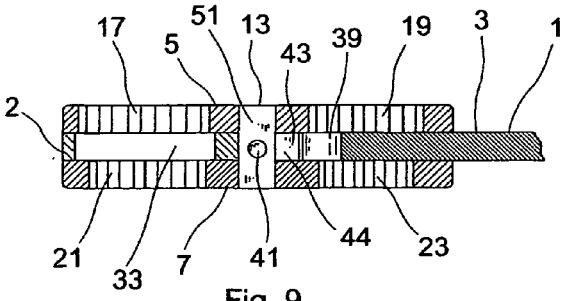
Figure 10:
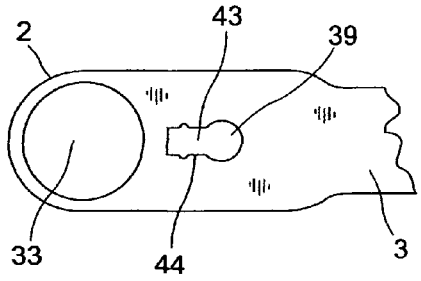

Referring now to FIGS. 9 and 10 together wherein FIG. 9 shows a right side, cut view of a portion of the present invention multi-socket wrench shown in FIGS. 1 through 8 with corresponding reference numbers; and, FIG. 10 shows a top partial view of the elongated main member of the present invention wrench shown in FIGS. 1 through 9 with corresponding reference numbers. In this embodiment of the present invention multi-socket wrench 1, locking slot 43 of first end 2 is shaped like a keyway with a round portion 39 for the free rotation of wrench unit attachment means 51; and, a locking portion 44 formed here as a rectangle for securing wrench unit attachment means 51. When attachment means 51 is positioned in circular portion 39 of locking slot 43, wrench units 5 and 7 which are fixedly connected to attachment means 51 (shown in FIG. 9) may be freely rotated. When attachment means 51 is inserted and positioned in locking portion 44 of locking slot 43 as shown in FIG. 9, wrench units 5 and 7 are rotatably secured to elongated main member 3 so that sockets 17 and 21; or, sockets 19 and 23 when turned to the outside may engage with and turn a work piece (not shown). A spring-loaded ball 41 in attachment means 51 shown in FIG. 9 prevents unintentional movement of attachment means 51 from locking portion 44 into round portion 39 of locking slot 43.

Figure 11:
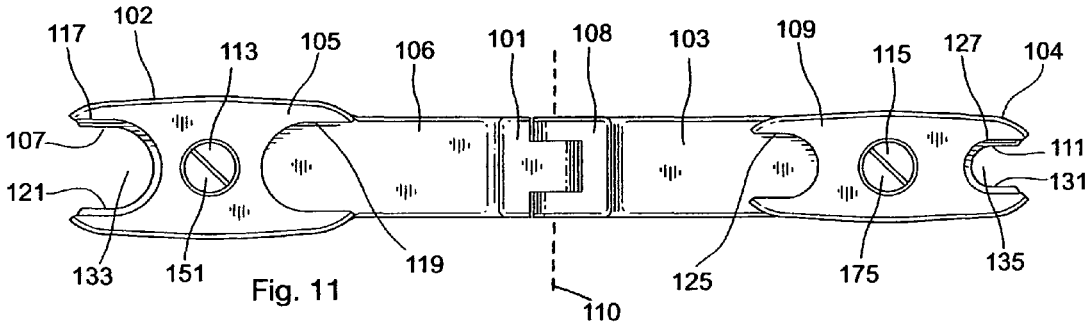

In FIG. 11, there is shown a top view of another embodiment of the present invention multi-socket wrench with wrench units having open end sockets. Here multi-socket wrench 101 has elongated main member 103 as shown. There is wrench unit 105 and wrench unit 107 located on the first end 102 of elongated main member 103. Both wrench units 105 on top and 107 on the bottom are attached to elongated main member 103 by attachment means 151 which includes fastener screw 113. Fastener screw 113 is a component of attachment means 151 that attaches wrench units 105 and 107 to elongated main member 103. Likewise, at the second end 104 of elongated main member 103 there are wrench units 109 and 111. Both wrench units 109 on top and 111 on the bottom are attached to elongated main member 103 by attachment means 175 which includes fastener screw 115. Fastener screw 115 is a component of attachment means 175 that attach wrench units 109 and 111 to elongated main member 103.

Wrench unit 105 includes a first socket size 117 and a second socket size 119, and wrench unit 107 on bottom has a third socket size 121 and a fourth socket size not seen in this view. Likewise, wrench unit 109 has a fifth socket size 125 and a sixth socket size 127, and wrench unit 111 on bottom has a seventh socket size not seen in this view, and an eighth socket size 131 as shown. The sockets in this embodiment of the present invention multi-socket wrench are formed with open ends and may be of any size or any combination of sizes but are preferably arranged in an order that would make up a set of wrenches or sockets in fractional and/or metric sizes. For example, a preferred sizing arrangement may be ¾, 11/16, ⅝, 9/16, ½, 7/16, ⅜ and 5/16 inches.

Elongated main member 103 also includes orifices 133 and 135 to provide for maximum usage of the present invention multi-socket wrench 101 and allows a threaded stud of a bolt or work-piece to pass through two open ended sockets.

Elongated main member 103 has a first end 102, a second end 104, and a middle section 106. Each of the first end 102, the second end 104, and the middle section 106 of elongated main member 103 comprise about one third the total length of elongated main member 103. Formed in the middle section 106 of elongated main member 103 is pivoting means 108 which has pivot axis 110. Pivoting means 108 allows the first end 102 of elongated main member 103 to be pivotably moved relative to the second end 104 of the elongated main member 103. And, pivoting means 108 has one pivot axis 110 which is located within the defined middle section 106 of elongated main member 103 to provide optimum accessibility and engagement of each and all of the eight open-ended sockets of multi-socket wrench 101.

Figure 12:
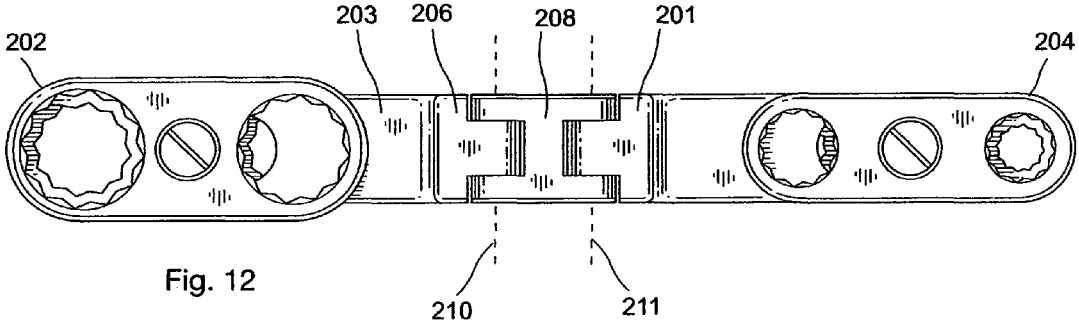
Figure 13:
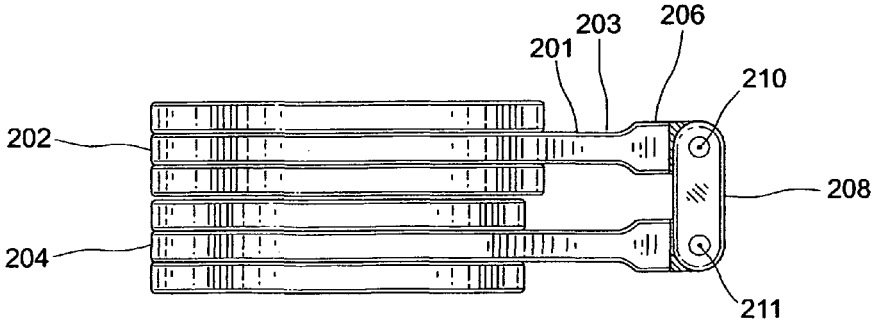

Referring now to FIGS. 12 and 13 together wherein, FIG. 12 shows a top view of another embodiment of the present invention multi-socket wrench with a pivoting means that has two pivot axes; and, FIG. 13 shows a right side view of the wrench shown in FIG. 12, with the wrench folded into a compact form. Here multi-socket wrench 201 has elongated main member 203 with a first end 202, a second end 204 and a middle section 206 as shown. A pivoting means 208 is formed in the middle section 206 of elongated main member 203. In each embodiment of the present invention multi-socket wrench, there is at least one pivoting means formed in the middle section of the elongated main member; and, the at least one pivoting means has at least one pivot axis. In this embodiment of the present invention shown here in FIGS. 12 and 13, the elongated main member 203 of wrench 201 has pivoting means 208 which comprises two pivoting axes 210 and 211 as shown. Such an arrangement not only provides for optimum accessibility and engagement of each and all of sockets, but allows wrench 201 to be folded into a compact form as shown in FIG. 13, for storage and transportation.

Upon reading and understanding the specification of the present invention described above, modifications and alterations will become apparent to those skilled in the art. It is intended that all such modifications and alterations be included insofar as they come within the scope of the patent as claimed or the equivalence thereof.

Having thus described the invention, the following is claimed:

1. A multi-socket wrench, which comprises:

(a) an elongated main member having an elongated dimension with an upper area, a lower area, a first end, a second end, and a middle section; and, (b) at least two wrench units, each wrench unit having an elongated dimension and having opposing elongated ends, each wrench unit having two sockets positioned side by side thereon, one of said at least two wrench units being rotatably attached at said upper area and another of said at least two wrench units being rotatably attached at said lower area of said first end of said elongated main member, said two sockets on each wrench unit being substantially opposite one another, each of said two sockets on each wrench unit being located at different opposing elongated ends of said wrench unit; and, (c) attachment means for attaching said wrench units to said elongated main member; and, (d) at least one pivoting means formed in said elongated main member whereby said first end of said elongated main member may be pivotably moved relative to said second end of said elongated main member, said at least one pivoting means having at least one pivot axis located within the defined middle section of said elongated main member, and further wherein, said first end, second end, and middle section each have at least one thickness dimension, and, said middle section has a thickness dimension greater than a thickness dimension of each of said first and second ends of said elongated main member.

2. The multi-socket wrench of claim 1, wherein said pivoting means of said elongated main member has only one pivot axis.

3. The multi-socket wrench of claim 1, wherein said pivoting means of said elongated main member has only two pivot axes.

4. The multi-socket wrench of claim 1, wherein said upper attached wrench unit is fixedly connected to said lower attached wrench unit by attachment means through said elongated main member whereby rotation of one of said wrench units causes coincidental rotation of the other of said wrench units.

5. The multi-socket wrench of claim 1, wherein said sockets are open end sockets.

6. A multi-socket wrench, which comprises:

(a) an elongated main member having an elongated dimension with an upper area, a lower area, a first end, a second end, and a middle section; and, (b) four wrench units, each wrench unit having an elongated dimension and having opposing elongated ends, each wrench unit having two sockets positioned side by side thereon, said four wrench units being rotatably attached to said elongated main member with one attached at the upper area of said first end, one attached at the lower area of said first end, one attached at the upper area of said second end, and one attached at the lower area of said second end, said two sockets on each wrench unit being substantially opposite one another, each of said two sockets on each wrench unit being located at different opposing elongated ends of said wrench unit; and, (c) attachment means for attaching said wrench units to said elongated main member; and, (d) at least one pivoting means formed in said elongated main member whereby said first end of said elongated main member may be pivotably moved relative to said second end of said elongated main member, said at least one pivoting means having at least one pivot axis located within the defined middle section of said elongated main member, and further wherein, said first end, second end, and middle section each have at least one thickness dimension, and, said middle section has a thickness dimension greater than a thickness dimension of each of said first and second ends of said elongated main member.

7. The multi-socket wrench of claim 6, wherein said pivoting means of said elongated main member has only one pivot axis.

8. The multi-socket wrench of claim 6, wherein said pivoting means of said elongated main member has only two pivot axes.

9. The multi-socket wrench of claim 6, wherein said upper attached wrench unit is fixedly connected to said lower attached wrench unit by attachment means through said elongated main member whereby rotation of one of said wrench units causes coincidental rotation of the other of said wrench units.

10. The multi-socket wrench of claim 6, wherein said sockets are open end sockets.

11. A multi-socket wrench, which comprises:

(a) an elongated main member having an upper area, a lower area, a first end, a second end, and a substantially non-hollow middle section, said first and second ends each having a predetermined direction of elongation; and, (b) at least two wrench units, each wrench unit having an elongated dimension and having opposing elongated ends, each wrench unit having two sockets positioned side by side thereon, one of said at least two wrench units being rotatably attached at said upper area and another of said at least two wrench units being rotatably attached at said lower area of said first end of said elongated main member, said two sockets on each wrench unit being substantially opposite one another, each of said two sockets on each wrench unit being located at different opposing elongated ends of said wrench unit; each said socket having a central axis, and, (c) attachment means for attaching said wrench units to said elongated main member; and, (d) at least one pivoting means formed in said elongated main member whereby said first end of said elongated main member may be pivotably moved relative to said second end of said elongated main member, said at least one pivoting means having at least one pivot axis located within the defined middle section of said elongated main member, and further wherein, the central axis of each said socket being positioned substantially perpendicular to the predetermined direction of elongation of said first end of said elongated main member.

12. The multi-socket wrench of claim 11, wherein said multi-socket wrench has four wrench units rotatably attached to said elongated main member with one attached at the upper area of said first end, one attached at the lower area of said first end, one attached at the upper area of said second end, and one attached at the lower area of said second end.

13. The multi-socket wrench of claim 11, wherein said pivoting means of said elongated main member has only one pivot axis.

14. The multi-socket wrench of claim 11, wherein said pivoting means of said elongated main member has only two pivot axes.

15. The multi-socket wrench of claim 11, wherein said upper attached wrench unit is fixedly connected to said lower attached wrench unit by attachment means through said elongated main member whereby rotation of one of said wrench units causes coincidental rotation of the other of said wrench units.

16. The multi-socket wrench of claim 11, wherein said sockets are open end sockets.

* * * * *